US007055410B2

(12) United States Patent
Hu

(10) Patent No.: US 7,055,410 B2
(45) Date of Patent: Jun. 6, 2006

(54) HAND TOOL AIDED SCREWDRIVER

(76) Inventor: Michael Hu, No. 205, Tu Tzu Tou, Tu Tou Village, Kuan Tien Shiang, Tainan Hsien (TW)

( * ) Notice: Subject to any disclaimer, the term of this patent is extended or adjusted under 35 U.S.C. 154(b) by 93 days.

(21) Appl. No.: 10/960,981

(22) Filed: Oct. 12, 2004

(65) Prior Publication Data

US 2006/0075852 A1 Apr. 13, 2006

(51) Int. Cl.
*B25B 13/46* (2006.01)

(52) U.S. Cl. ..... 81/62; 81/63.1; 81/60

(58) Field of Classification Search ..... 81/62, 81/63.1, 60, 61, 63, 437
See application file for complete search history.

(56) References Cited

U.S. PATENT DOCUMENTS 2,513,509 A * 7/1950 Morts ..... 81/436
4,235,269 A * 11/1980 Kraus ..... 81/438
5,642,649 A * 7/1997 Hsieh ..... 81/58.1
6,330,843 B1 * 12/2001 Lin ..... 81/63.1
6,363,819 B1 * 4/2002 Li ..... 81/438
6,389,932 B1 * 5/2002 Ho ..... 81/62
6,450,067 B1 * 9/2002 Liao ..... 81/62
6,647,831 B1 * 11/2003 Hu ..... 81/60
6,732,613 B1 * 5/2004 Hsieh ..... 81/58.3
6,817,458 B1 * 11/2004 Gauthier ..... 192/43.1
6,902,047 B1 * 6/2005 Ting ..... 192/43.2
6,928,906 B1 * 8/2005 Marks ..... 81/185

* cited by examiner

*Primary Examiner*—Lee D. Wilson
*Assistant Examiner*—Alvin J. Grant
(74) *Attorney, Agent, or Firm*—Rosenberg, Klein & Lee

(57) ABSTRACT

A hand tool aided screwdriver related to a ratchet screwdriver that allows operation in changed direction includes a handle, a ratchet holder, a socket, and a chock. The ratchet holder is inserted into a chamber in the handle. The socket is inserted into the ratchet holder. The ratchet holder is provided with an outer ratchet to engage with an inner ratchet in the chock. The chock having a hexagon outer surface to be held by an open end of a spanner to apply force together with the screwdriver in mounting or dismounting a work piece.

3 Claims, 4 Drawing Sheets

A - A

HAND TOOL AIDED SCREWDRIVER

BACKGROUND OF THE INVENTION (a) Field of the Invention

The present invention relates to a hand tool aided screwdriver, and more particularly to a ratchet screwdriver allowing extra force to be jointly applied on a work piece from another hand tool such as a spanner by leverage.

(b) Description of the Prior Art

As taught in U.S. Pat. No. 6,260,446 for a ratchet screwdriver that permits application of extra force to drive a screw or a bolt in one direction or in a changed direction. However, as the force applied is limited only to that from the wrist of the user, more efforts are still needed for a job involving greater torque.

SUMMARY OF THE INVENTION

The primary purpose of the present invention is to provide a hand tool aided screwdriver to apply extra force on a work piece that requires greater torque. It saves efforts, allows one-way application of force, adaptable to socket with different recesses on both ends for connection with a screwdriver tip or socket depending on the type of the user to apply force using one hand or a spanner. To achieve the purpose, a socket is inserted into a ratchet holder; a chock having a hexagon outer surface is secured on the ratchet holder.

DETAILED DESCRIPTION OF THE PREFERRED EMBODIMENTS

Figure 1:
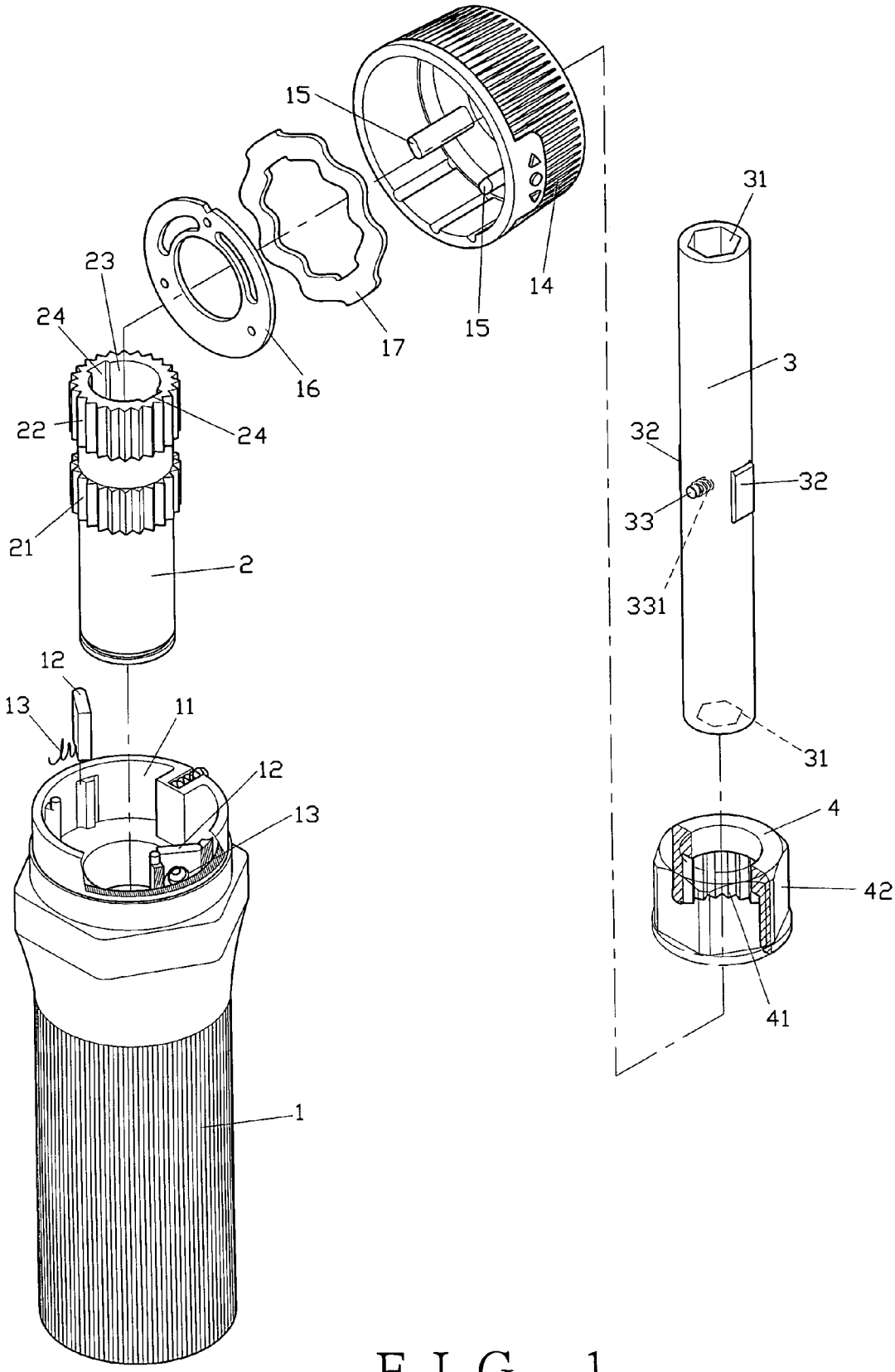
FIG. 1 is an exploded view of a preferred embodiment of the present invention.
Figure 2:
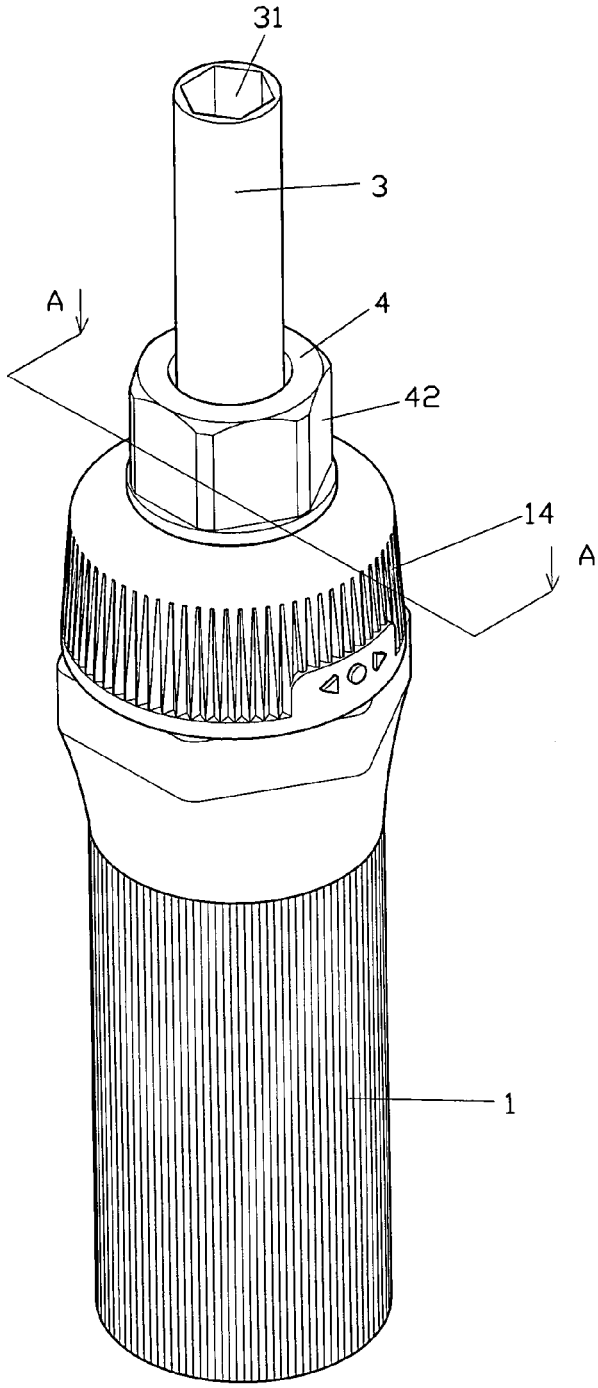
FIG. 2 is a perspective view of the preferred embodiment of the present invention as assembled.

Referring to FIGS. 1, and 2, a preferred embodiment of the present invention comprises a handle (1), a ratchet holder (2), a socket (3), and a chock (4).

The handle (1) includes a chamber (11) containing two stoppers (12) each inserted with a spring (13). The chamber (11) is capped with a locking ring (14). The locking ring (14) contains two studs (15) to respectively hold against the stoppers (12) as the locking ring (14) is turned around. The locking ring (14) is inserted inside with a dust lid (16) and a gasket (17).

The ratchet holder (2) is secured into the chamber (11) of the handle (1). A ratchet (21) is provided on the middle section of the ratchet holder (2) to turn in one-way direction when held against by the stoppers (12). The top of the ratchet holder (2) exposes out of the locking ring (14) of the handle (1) and has on its outer circumference provided with an outer ratchet (22). A through hole (23) is provided in the ratchet holder (2). Two slots (24) are axially provided inside the through hole (23).

The socket (3) with two ends each disposed with a recess (31) is adjustably inserted into the through hole (23) of the ratchet holder (2). Two locking bits (32) opposite to each other are provided on the middle section of the socket (3). A bead (33) containing a spring (331) to provide elastic expansion for the bead (33) is provided also on the middle section of the socket (3).

The chock (4) secured on the ratchet holder (2) contains an inner ratchet (41) to engage with the outer ratchet (22) of the ratchet holder (2). The outer surface of the chock (4) is made in the form of a hexagon outer surface (42) for another hand tool to hold onto it.

Figure 3:
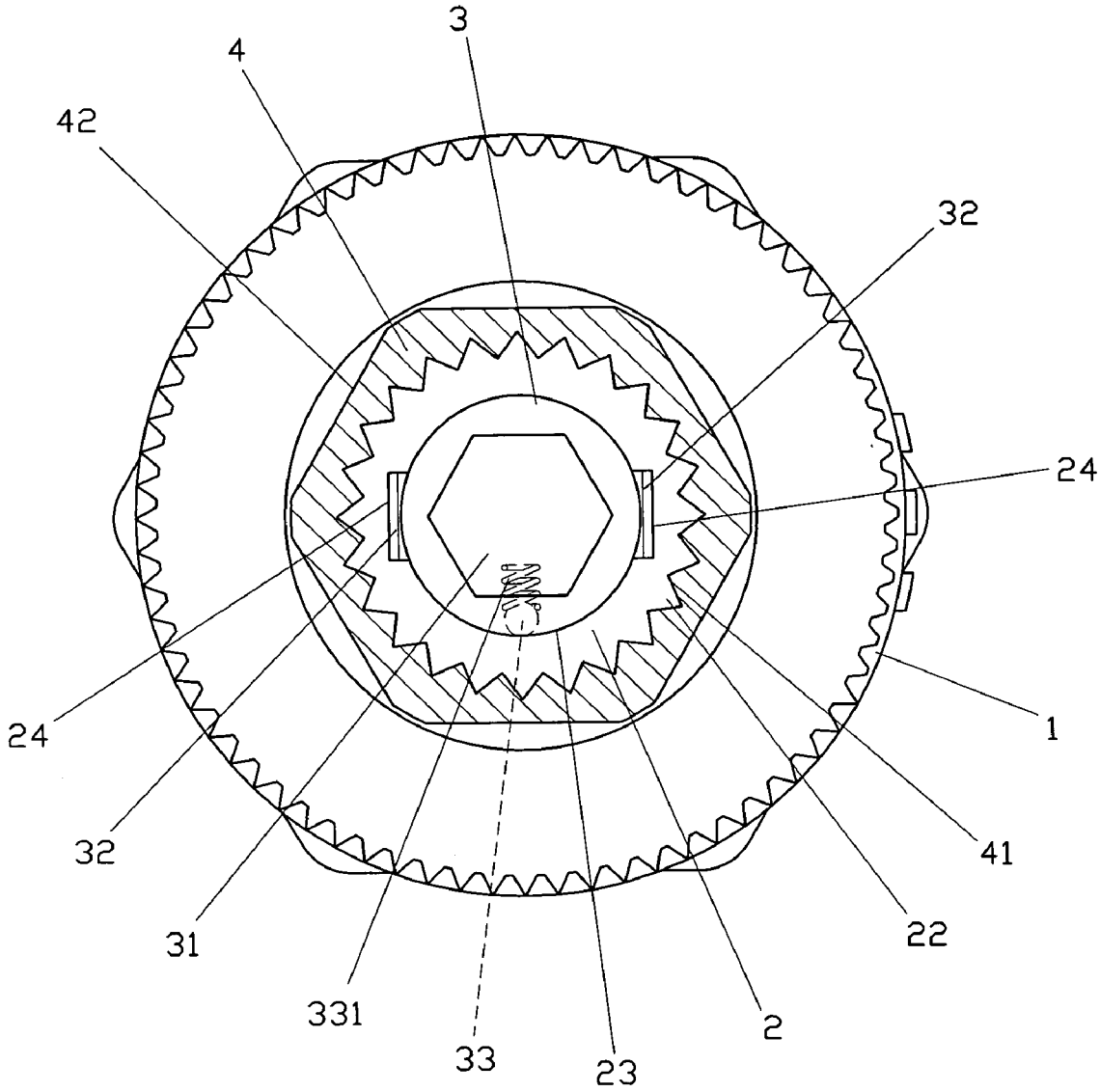
FIG. 3 is a cross-sectional view of the preferred embodiment of the present invention as assembled.

When assembled, the ratchet holder (2) is inserted into the chamber (11) of the handle (1) with the ratchet (21) held against by the stoppers (12). The dust lid (16) and the gasket (17) are inserted onto the ratchet holder (2). The locking ring (14) is inserted onto the opening of the chamber (11) of the handle (1) to expose the outer ratchet (22) out of the locking ring (14). Either end of the socket (3) is inserted into the through hole (23) of the ratchet holder (2), as illustrated in FIG. 3. The locking bits (32) of the socket (3) are respectively engaged with the slots (24) of the ratchet holder (2). The bead (33) of the socket (3) is elastically holding against the inner edge of the through hole (23) of the ratchet holder (2) so as to secure the socket (3) inside the ratchet holder (2). The chock (4) is then inserted onto the ratchet holder (2) so that the inner ratchet (41) of the chock (4) and the outer ratchet (22) of the ratchet holder (2) are tightly adapted to and locked in place with each other. Accordingly, the chock (4) is firmly secured to the ratchet holder (2) to complete the assembly of the preferred embodiment of the present invention.

Figure 4:
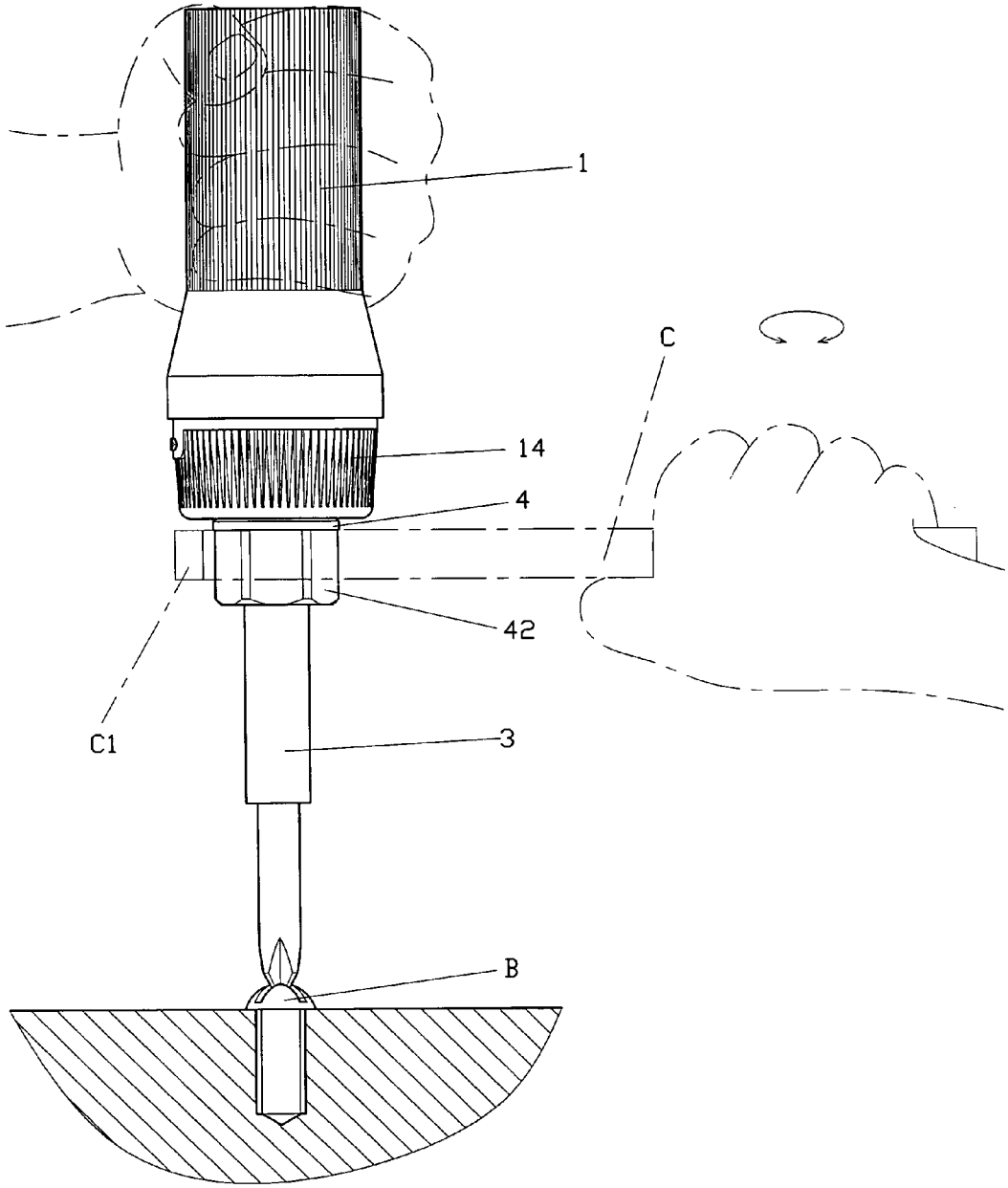
FIG. 4 is a side view showing that a spanner is used to help the preferred embodiment of the present invention to apply force on a work piece.

When a job involving a work piece (B) demanding much greater torque for installation or removal as illustrated in FIG. 4, the user has one hand holding the handle (1) to plunge against the work piece (B) and another hand holding another hand tool, a spanner (C) as illustrated, with its open end (C1) to clip the hexagon outer surface (42) of the chock (4) to apply force by turning the spanner (C) thus to provide greater torque to the work piece (B). Upon turning the chock (4), greater torque is produced and applied on the socket (3) since the chock (4) is secured to the ratchet holder (2) and the ratchet holder (2) in turn is coupled with the socket (3) to mount or dismount the work piece (B). Therefore, the present invention by providing extra force applied to a work piece at less effort eliminates the insufficient force applied to the work piece (B) only by the handle (1) using one's wrist.

When the socket (3) has to work with a screwdriver bit or another socket in different specification, the socket (3) is pulled out of the ratchet holder (2) and has another end of the socket (3) inserted into the through hole (23) of the ratchet holder (2). The locking bits (32) of the socket (3) are respectively engaged with the two slots (24) of the ratchet holder (2), and the bead (33) of the socket (3) holds against the inner edge of the through hole (23) of the ratchet holder (2) so to secure the socket (3) inside the ratchet holder (2). The recess (31) provided on the other end of the socket (3) is to receive the screwdriver bit or another socket to mount or dismount a work piece.

I claim:

1. A hand tool aided screwdriver comprising a handle and a ratchet holder; the handle containing a chamber, the chamber containing stoppers each adapted with a spring; the chamber being capped with a locking ring; the locking ring containing studs to hold against the stoppers; the ratchet holder being secured in the chamber of the handle; a ratchet being provided on an outer circumferential portion of the ratchet holder to turn in one-way direction as restricted by the stoppers; and characterized by:

said screwdriver further comprising a socket and a chock, the socket being inserted into the ratchet holder; and the chock provided with a hexagon outer surface being secured on the ratchet holder.

2. The hand tool aided screwdriver of claim 1, wherein the ratchet holder is provided with an outer ratchet exposed out of the locking is ring of the handle; an inner ratchet being provided in the chock; the inner ratchet of the chock being engaged with the outer ratchet of the ratchet holder.

3. The hand tool aided screwdriver of claim 1, wherein two locking bits and one bead are provided on an outer circumferential portion of the socket; the bead containing a spring to provide elastic expansion for the bead; a through hole being provided in the ratchet holder to receive insertion of the socket; two slots being provided on an inner wall of the through hole of the ratchet holder to receive the locking bits of the socket.

* * * * *